US005524544A

United States Patent [19]

O'Meara et al.

[11] Patent Number: 5,524,544

[45] Date of Patent: Jun. 11, 1996

[54] NITROCELLULOSE PROPELLANT CONTAINING A CELLULOSIC BURN RATE MODIFIER

[75] Inventors: William L. O'Meara, Tallahassee; Terry A. Murray, Quincy, both of Fla.

[73] Assignee: Olin Corporation, St. Petersburg, Fla.

[21] Appl. No.: 278,360

[22] Filed: Jul. 21, 1994

[51] Int. Cl.[6] ..... C06D 5/06

[52] U.S. Cl. ..... 102/287; 102/289; 102/290; 102/291

[58] Field of Search ..... 149/100; 102/287, 102/291, 292, 290, 289

[56] References Cited

U.S. PATENT DOCUMENTS

| | | | |
|---|---|---|---|
| 3,235,425 | 2/1966 | Clemens et al. | 148/48 |
| 3,798,085 | 3/1974 | Mellow | 149/10 |
| 4,097,316 | 6/1978 | Mullay | 149/2 |
| 4,354,884 | 10/1982 | Williams | 102/290 X |
| 4,525,313 | 6/1985 | Muller | 149/96 X |
| 4,597,994 | 7/1986 | Bolinder et al. | 102/290 X |
| 4,654,093 | 3/1987 | Bolinder et al. | 102/290 X |
| 4,841,863 | 6/1989 | Bourgeois | 102/283 X |
| 4,842,659 | 6/1989 | Mezger et al. | 149/88 X |
| 4,886,560 | 12/1989 | Cartwright | 149/12 |
| 4,950,342 | 8/1990 | Canterberry | 102/290 X |
| 5,269,224 | 12/1993 | Gonzales et al. | 102/288 |
| 5,398,612 | 3/1995 | Graham et al. | 102/287 |

OTHER PUBLICATIONS

Modern Plastics, Mid–Oct. 1991. Resins and Compounds, Cellulosics.

Publication by Eastman Kodak Company (1990) Cellulose Esters.

*Primary Examiner*—Peter A. Nelson

*Attorney, Agent, or Firm*—Gregory S. Rosenblatt

[57] ABSTRACT

There is disclosed a propellent having a deterred burn rate. The propellent is a particulate containing a nitrocellulose base and a cellulosic thermoplastic deterrent, preferably cellulose acetate butyrate or cellulose acetate propionate. The deterrent is gradationally dispersed within the particulate with the greatest concentration of deterrent at the particulate periphery.

7 Claims, 2 Drawing Sheets

NITROCELLULOSE PROPELLANT CONTAINING A CELLULOSIC BURN RATE MODIFIER

BACKGROUND OF THE INVENTION

1. Field of the Invention

This invention relates to a burn rate modifier for nitrocellulose base propellants. More particularly, a cellulose acetate deterrent is gradationally diffused into the propellant, with the maximum concentration of deterrent on the surface.

2. Description of Related Art

Smokeless propellant powder compositions containing a nitrocellulose base, either alone or in combination with other propellant babes, represent the most common gun powder in use today.

When the base is nitrocellulose, the propellant is referred to as a single base propellant. When the base is a mixture of nitrocellulose and nitroglycerin, the base is referred to as a double base propellant. When the base is a mixture of nitrocellulose, nitroglycerin and nitroguanidine, the propellant is referred to as a triple base propellant.

The propellant base is provided in either spherical (spheroidal) or modified spherical (oblate spheroids) globular powders manufactured by either a batch process or a continuous process. There are many different commercially available types of globular propellant powders, the difference primarily being in terms of the web (thickness), grain size, amount of nitroglycerin (an energy booster) and deterrent composition (to slow burning). The ammunition maker may also look to other powder types such as extruded or flake if globular powders do not give the proper ballistics.

The propellant powders have a high burn rate and may require the presence of a burn deterrent to reduce the initial burn rate of the powder composition and to impart a burn rate gradient to produce a high projectile velocity while preventing unduly high chamber pressures.

Among the deterrents known for nitrocellulose base propellants are linear polyesters as disclosed in U.S. Pat. No. 3,798,085 to Mellow and a polycaprolactone polymer as disclosed in U.S. Pat. No. 4,950,342 to Canterberry. Both the Mellow and the Canterberry patents are incorporated by reference in their entirety herein. Deterrents are classified as either "plasticizer type" or "barrier type". The plasticizer type deterrent diffuses into the propellent grains while the barrier type is normally not capable of diffusion into the propellent grains and coats the surface.

U.S. Pat. No. 4,354,884 to Williams discloses that single and double base propellants are usually coated from an aqueous solution containing dissolved deterrent. When the water is driven off, a coating of deterrent remains behind. With triple base propellants, nitroguanidine is water soluble and a nonaqueous solvent is required. One suitable solvent is methyl alcohol. The triple base propellant is immersed in the nonaqueous solution containing dissolved deterrent for a desired time, water rinsed and dried.

It is desirable to diffuse the deterrent into the propellant grains to establish a concentration gradient. The concentration of the deterrent is highest along the outside surface of the propellant grain and decreases to approximately zero at some point within the propellant grain. This concentration gradient slows down the burn rate when the propellant grains are large, reducing ballistic pressure. The burn rate increases as the size of the propellant decreases, maintaining a constant ballistic pressure.

If the concentration gradient changes, typically heat causes the deterrent to migrate inward, a negative ballistic effect occurs. The burn rate at the surface of the propellent grains increases, leading to increased ballistic pressure. As the grain size decreases, the increased amount of deterrent reduces the burn rate, leading to a drop in pressure.

Ballistic stability is the capability of the deterrent to remain in the original concentration gradient without migrating. A problem with currently used deterrents is ballistic instability. When exposed to elevated temperatures (65° C. and higher) the prior art deterrents migrate, causing the ballistic performance to change.

There exists, therefore, a need for a deterrent for a nitrocellulose base propellant that has greater ballistic stability than those of the prior art.

SUMMARY OF THE INVENTION

Accordingly, it is an object of the invention to provide a deterrent for nitrocellulose base propellants having improved ballistic stability. It is a second object of the invention to provide a method for depositing the deterrent into the propellant with a concentration gradient such that the maximum amount of deterrent is at the surface.

It is a feature of the invention that a cellulosic polymer is utilized as the deterrent. It is a feature of the invention that the cellulosic deterrent is placed into the propellent under elevated temperature and high solvent levels. Yet another feature of the invention is that while the cellulosic thermoplastic is a barrier type deterrent, by using the proper solvent and heat, diffusion into the propellant is achieved.

It is an advantage of the invention that the cellulosic deterrent migrates less than linear polyester and other conventional deterrents. There is minimal deterrent migration after storage at either room temperature or elevated temperatures for extended periods of time. Another advantage of the invention is that the cellulosic thermoplastic deterrents are compatible with both single base and double base smokeless propellants.

In accordance with the invention, there is provided a propellant. The propellant contains a particulate having a nitrocellulose base. A cellulosic thermoplastic deterrent is gradationally dispersed in an exterior portion of the propellant particulate. The deterrent concentration is greatest about the periphery of the particulate and then decreases inwardly.

In accordance with a second embodiment of the invention, there is provided a method for the manufacture of a propellant. An aqueous suspension containing nitrocellulose particulate is heated to a temperature of from about 30° C. to about 70° C. A nonaqueous solution containing from about 1% to about 25% by weight dissolved cellulosic thermoplastic is then added to the aqueous solution. The nonaqueous/aqueous solution mix is then agitated for a time effective for the nonaqueous solution to penetrate at least partially into the particulate. Substantially all the solvent component of the nonaqueous solution and the water are then removed to produce cellulosic thermoplastic coated particulate.

The above-stated objects, features and advantages will become more apparent from the specification and drawings which follow.

DETAILED DESCRIPTION

Figures 1, 2:
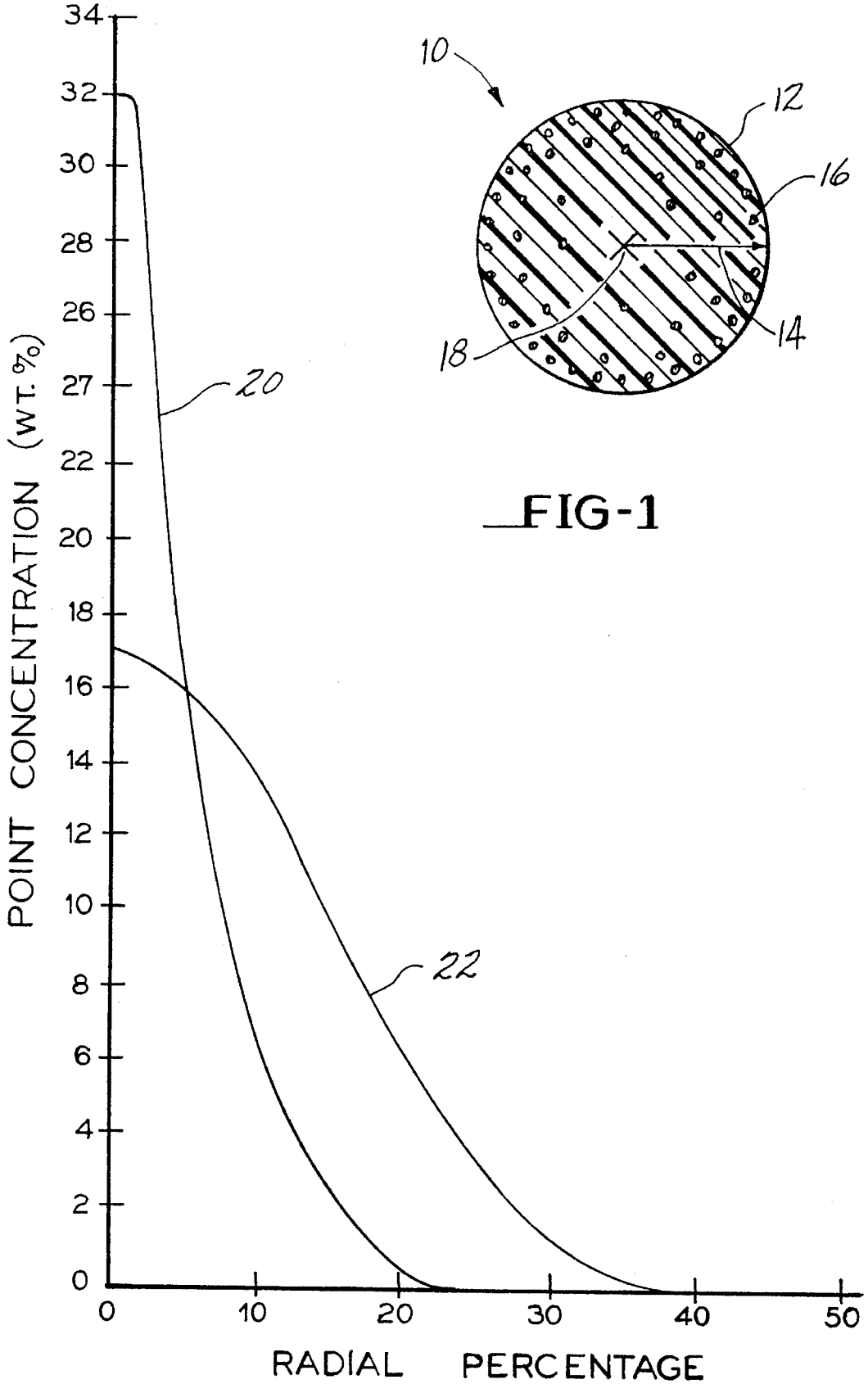
FIG. 1 shows in cross-sectional representation a propellant particulate containing the deterrent of the invention.
FIG. 2 graphically illustrates the concentration gradient of the deterrent after storage for 30 days at 20° C.

FIG. 1 shows in cross-sectional representation a particulate 10 according to the present invention. The particulate 10 contains a nitrocellulose base, constituting a single base smokeless powder and may optionally contain nitroglycerine as a double base smokeless powder. When nitroglycerin is present, the weight ratio of nitroglycerin to nitrocellulose is from about 1:1 to about 1:9.

While FIG. 1 illustrates the particulate 10 as a sphere, the particulate may be any desired shape. Spheroidal (sphere like), oblate spheroidal (football shaped), cylindrical, equiaxed polyhedron, flake or ribbon are suitable examples. Notwithstanding the shape of the particulate 10, the particulate 10 has a periphery 12 defining the outermost surface.

Spheres and other fluent shapes are most preferred for ease of loading a cartridge. When the particulate 10 is a sphere, the radius 14 is from about 100 microns to about 4000 microns. Preferably, the radius 14 is from about 100 to about 1000 microns. When other shapes are utilized, the particulate size is that effective to achieve an approximately similar volume of particulate.

Dispersed within the particulate 10 is a deterrent 16. The deterrent 16 is gradationally dispersed in an exterior portion of the particulate 10 such that the concentration of deterrent is greatest around the periphery 12 and decreases inwardly towards the center 18 of the particulate. Preferably, the weight percent concentration of deterrent relative to propellent is from about 10% to about 50% at the periphery 12. More preferably, the weight percent of deterrent is from about 10% to about 30% at the periphery 12. The weight percent decreases inwardly toward the center 18 and approaches zero at a point between 20% and 40% along the radius 14, being closer to the periphery 12 than the center 18. More preferably, the point of essentially zero deterrent is from about 20% to about 30% of the way inwardly along the radius 18.

The preferred deterrents are cellulosic thermoplastics constituting repetitive utilization of the anhydroglucose unit ($C_6H_{10}O_5$). The preferred cellulosic thermoplastics are cellulose esters formed by mixing cellulose with the appropriate organic acids, acid anhydrides and catalysts. Preferred materials include cellulose acetates such as cellulose acetate butyrate and cellulose acetate propionate.

Generic chemical formulas for the preferred deterrents are:

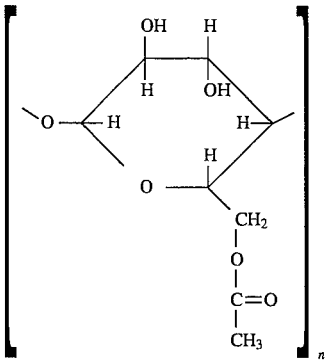

Cellulose acetate

-continued

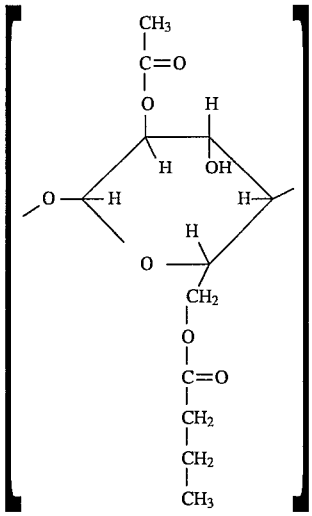

Cellulose acetate butyrate

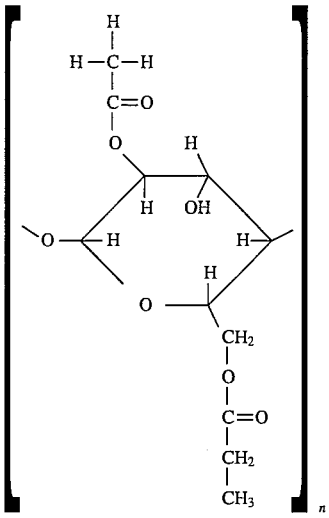

Cellulose acetate propionate

The preferred cellulose esters are not fully acylate, but contain from about 3% to about 12% by weight of hydroxyl. These materials are available from Eastman Chemical Products of Kingsport, Tenn.

The cellulosic thermoplastics have a weight average molecular weight in the range of from about 10,000 to about 100,000 mass units and preferably from about 12,000 to about 75,000 mass units and are compatible with both nitrocellulose and nitroglycerin.

The particulate 10 is manufactured by first preparing an aqueous suspension containing nitrocellulose. The water to propellent ratio (by weight) is from about 2:1 to about 20:1 and preferably from about 5:1 to about 15:1. The solution is added to a mixing vessel, and heated and agitated until the contents form a slurry at a temperature of from about 30° C. to about 70° C. and preferably from about 40° C. to about 60° C. If nitroglycerin is required for a double base powder, the desired amount of nitroglycerin is gradually added at this time. The contents are then mixed under approximately constant agitation and temperature for a period of from about 60 minutes to about 240 minutes.

When the aqueous suspension is well mixed, the cellulosic deterrent is added. The cellulose deterrent is dissolved in ethyl acetate or another suitable nonaqueous solvent. The amount of the cellulosic thermoplastic in the nonaqueous solvent is between about 1% and about 25% by weight and preferably between about 5% and 20%. The nonaqueous solution is then added to the mixing vessel over an extended period of time, typically from about 5 minutes to about 120 minutes.

The temperature of the mixing vessel is then increased to from about 40° C. to the boiling temperature of the nonaqueous solvent, 72° C. for ethyl acetate. The deterrent penetrates into the propellent grains with the aid of the ethyl acetate. Unlike linear polyester and other plasticizing deterrents, the cellulosic deterrent does not diffuse by its own plasticizing action. As a result, the melting temperature of the cellulosic deterrent is not critical as with linear polyesters. A preferred temperature range for the vessel during the ethyl acetate penetration step is between about 50° C. and 70° C. The temperature and agitation are maintained for the amount of time required for the desired amount of penetration, typically from about 1 minute to about 480 minutes, and preferably from about 30 minutes to about 120 minutes.

Preferably, the weight percent of deterrent in dried propellant is between about 0.5% and 10% by weight and preferably from about 3% to about 7% by weight of the dried propellent.

At the end of the deterrent contact period, the agitating vessel and contents are heated to a temperature effective to separate the ethyl acetate from the aqueous solution. The effective temperature is preferably between about 72° C. and 90° C. Distillation is continued for a period of time necessary to remove substantially all the ethyl acetate, typically between about 1 hour and 12 hours.

Following removal of the ethyl acetate, the coated propellent is rolled to a desired web and the water is removed. The water is removed by heating or other suitable means such as vacuum assisted heating. Heating to a temperature of from about 60° C. to about 80° C. for from about 2 to about 12 hours is satisfactory. Preferably, the water content is less than about 1% by weight and preferably less than about 0.5%–0.75% by weight.

To enhance flow, the outside of the dried deterred propellant is preferably coated with a small amount, typically less than 1% and preferably from about 0.1–0.5% by weight graphite.

The advantage of the propellant of the invention will be more apparent from the examples which follow. The examples are illustrative and not intended to limit the scope of the invention.

EXAMPLES

A nitrocellulose base substantially spheroidal propellent having a radius of 0.338 mm (0.0133 inch) was coated with either a linear polyester deterrent or a cellulose acetate butyrate deterrent. The maximum concentration of deterrent was at the periphery of the spheroidal propellant. The propellent concentration gradient decreased, approximately linearly, to about zero percent at a point along the radius about 20% inward from the outer periphery 12.

The propellants were stored at either 20° C. or 65° C. for 30 days. The concentration gradient of the deterrent was then analytically mapped using Fourier Transform Infrared Microscope Spectrometry.

FIG. 2 graphically illustrates the concentration gradient of the propellent samples stored for 30 days at 20° C. There was almost no change in the concentration gradient of the propellent containing the cellulosic deterrent of the invention as indicated by reference line 20 or of the linear polyester deterrent as indicated by reference line 22 when compared to the deterrent gradient of as-formed propellent.

Figure 3:
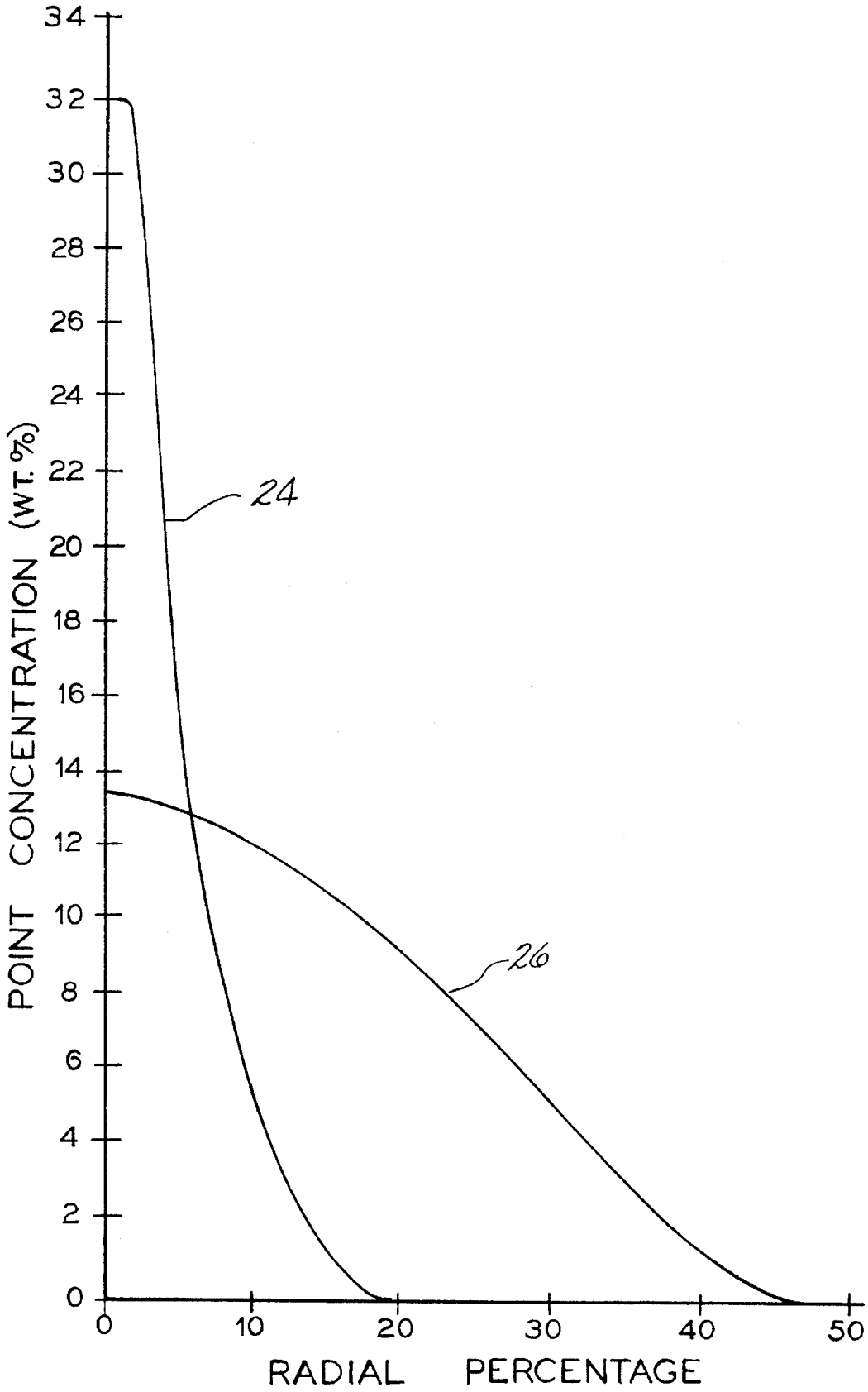
FIG. 3 graphically illustrates the concentration gradient of the deterrent after storage for 30 days at 70° C.

FIG. 3 graphically illustrates the concentration gradient for similar propellants containing similar deterrents stored at 70° C. for 30 days. Reference line 24 shows almost no shift in the concentration gradient of the cellulosic deterrent while reference line 26 shows a significant shift in the linear polyester gradient.

It is apparent that there has been provided in accordance with this invention a nitrocellulose base propellent containing a deterrent having improved ballistic stability and a method for the manufacture of the deterred propellent that fully satisfy the objects, features and advantages set forth hereinbefore. While the invention has been described in combination with specific embodiments thereof, it is evident that many alternatives, modifications and variations will be apparent to those skilled in the art in light of the foregoing description. Accordingly, it is intended to embrace all such alternatives, modifications and variations as fall within the spirit and broad scope of the appended claims.

We claim:

1. A propellant, comprising:

a plurality of particulates that burn from a periphery inward, each said particulate containing a nitrocellulose base; and a cellulosic thermoplastic burn deterrent gradationally dispersed in an exterior portion of said particulate, said burn deterrent concentration greatest about the periphery of each said particulate and decreasing inwardly.

2. The propellent of claim 1 wherein said cellulosic thermoplastic deterrent is a cellulose acetate.

3. The propellent of claim 2 wherein said cellulosic thermoplastic deterrent is selected from the group consisting of cellulose acetate butyrate and cellulose acetate propionate.

4. The propellent of claim 2 wherein said cellulosic thermoplastic deterrent has a weight average molecular weight of from about 10,000 to about 100,000.

5. The propellent of claim 4 wherein said cellulosic thermoplastic deterrent has a weight average molecular weight of from about 12,000 to about 75,000.

6. The propellent of claim 4 wherein the concentration of cellulose acetate at a radial point of from about 20% to about 40% inward of the periphery is essentially zero.

7. The propellent of claim 6 wherein the concentration of cellulose acetate at a radial point of from about 20% to about 30% inward of the periphery is essentially zero.

* * * * *